US006592405B1

(12) United States Patent
Hasircoglu

(10) Patent No.: US 6,592,405 B1
(45) Date of Patent: Jul. 15, 2003

(54) LATCH FOR GROUND SHIELD OF AN ELECTRICAL CONNECTOR

(75) Inventor: Alexander William Hasircoglu, Columbia, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/043,425

(22) Filed: Jan. 10, 2002

(51) Int. Cl.[7] ..... H01R 13/648
(52) U.S. Cl. ..... 439/607
(58) Field of Search ..... 439/607–610

(56) References Cited

U.S. PATENT DOCUMENTS 5,456,618 A * 10/1995 Nakamura ..... 439/610
6,113,428 A * 9/2000 Yeh ..... 439/609
6,146,193 A * 11/2000 Yu ..... 439/541.5

* cited by examiner

*Primary Examiner*—P. Austin Bradley
*Assistant Examiner*—Ross Gushi

(57) ABSTRACT

A latch assembly is provided for latching a ground shield around an electrical connector. The latch assembly comprises a latch receptacle portion and a latch insert portion. The latch receptacle portion comprises a receptacle main body, and a strap that is offset from the receptacle main body. The strap defines a slot between the strap and the receptacle main body. The latch receptacle portion also includes a window that is formed within the receptacle main body. The latch insert portion comprises a latch insert portion having an insert main body and a tongue, which is offset from the plane of the main body, with a latching projection formed on, and extending from, one side of the tongue. The strap exerts a normal, uniform force on the tongue thereby biasing the latching projection into the window. Consequently, the latch assembly remains fully engaged because of the force exerted on the tongue by the strap. A method is also provided for manufacturing a ground shield for an electrical connector. The method comprises the steps of stamping the latch receptacle portion from a first end of a stock material and stamping the latch insert portion from a second end of the stock material. The method also includes the steps of forming a latching projection extending outward from the tongue and offsetting a strap from the latch receptacle portion to form a slot between the window in the main body of the latch receptacle portion.

12 Claims, 11 Drawing Sheets

LATCH FOR GROUND SHIELD OF AN ELECTRICAL CONNECTOR

BACKGROUND OF THE INVENTION

Certain embodiments of the present invention generally relate to a latch, and more particularly to a latch for a ground shield that encloses an electrical connector.

Connectors are known for interconnecting various electrical media, components, and structures such as printed circuit boards (PCBs), coaxial cables, discrete circuit components, flex circuits and the like. The connectors may interconnect signal and/or power lines between two similar or different media, components and structures, such as between a flex circuit and a PCB, between two PCBs and the like. An example of an interconnection between two PCBs is a board-to-board connector. Connectors are offered in a variety of shapes and sizes, depending upon several competing criteria.

Typically, connectors include a connector interface and an interface with another media, component or structure (hereafter, generally a "circuit interface"). The circuit interface may include signal and ground contacts, or pins, that may be retained within receptacles formed in a circuit board, flex circuit and the like. The connector interface may also include signal and ground contacts. The connector interface of one connector typically mates with a connector interface of another connector, which, in turn, may be connected to a different printed circuit board, flex circuit or the like. Thus, the mating of connectors provides a path over which high-speed data signals from one circuit may travel to and from another circuit.

In many applications, it is desirable to protect electrical components of systems surrounding or proximate the electrical connectors, and to protect the quality of signals passing from one circuit to another. At least limited signal and component protection has been afforded by covering connectors with a ground shield of suitable stock material. Typically, a ground shield covers portions of a connector that do not interface with other connectors or other circuits. A typical ground shield includes a latching mechanism that securely latches the ground shield around the connector.

Typical latching mechanisms include a latch insert portion and a receptacle portion. The receptacle portion receives a latching protrusion located on the latch insert portion. The latching protrusion is biased into the receptacle portion thereby securing or engaging the latch. The latch is held engaged by a constant external force applied to the latch from below the latch protrusion. That is, the latch typically requires a directional force exerted by an external structure, such as a housing of the electrical connector or a spring member on the latch, to ensure that the latch remains engaged. Without directional forces exerted by the supporting structure positioned underneath the latch, or by the latch itself (for example, a spring member), the latch would disengage due to the fact that there is no force biasing the latch projection of the latch insert portion into the latch receptacle portion. Further, even when directional forces are exerted by supporting structure, such as an electrical connector, the latch may disengage if the connector housing warps, expands or shrinks. Also, the connector housing may have irregular and/or non-uniform surfaces that exert an uneven, non-uniform normal force on the latch. Consequently, the latch may disengage due to the non-uniform force exerted upon it.

Thus a need exists for a more robust latch that secures a ground shield over an electrical connector. Also, a need exists for a ground shield latch that remains engaged without external directional forces being exerted by supporting structure positioned underneath the latch.

BRIEF SUMMARY OF THE INVENTION

In accordance with certain embodiments of the present invention, a latch assembly for latching a ground shield has been developed. The latch assembly latches together ends of the ground shield. The ground shield covers an electrical connector. The latch assembly comprises a latch receptacle portion and a latch insert portion. The latch receptacle portion includes a receptacle main body arranged in a first plane and a strap arranged in a second plane that differs from the first plane. The strap is spaced apart from the receptacle main body to define a slot therebetween. The latch receptacle portion also includes a clearance bridge and a window provided in the receptacle main body. The clearance bridge is formed between the strap, which is formed at the edge of the ground shield, and the window. That is, the clearance bridge separates the strap from the window.

The latch insert portion includes an insert main body and a tongue with a latching projection formed on, and extending from, one side of the tongue. The tongue is offset from a plane containing the insert main body. When the latch receptacle portion and latch insert portion are joined, the strap exerts a normal force on the tongue biasing the latching projection into the window. In order to latch the latch insert portion and the latch receptacle portion together, the tongue is inserted into the slot and the tongue and/or the strap is deflected as the tongue traverses the clearance bridge toward said window. When the latch assembly is fully engaged, that is, fully latched, the receptacle main body and the insert main body are coplanar. Also, when fully engaged, the strap and the receptacle main body sandwich the tongue therebetween.

In certain embodiments of the present invention, the latch receptacle portion and the latch insert portion are formed integrally from a common piece of stock material. The latch receptacle portion may be stamped from one end of the stock material and the latch insert portion may be stamped on a second end of the stock material.

Certain embodiments of the present invention also provide a method of manufacturing a ground shield for an electrical connector. The method comprises the steps of first stamping a latch receptacle portion, having a receptacle main body and a strap, from a first end of a ground shield second stamping a latch insert portion, having an insert main body and a tongue extending from the insert main body, from a second end of the ground shield forming a latching projection extending outward from the tongue and offsetting a strap from the latch receptacle portion to form a slot between the window in the main body of the latch receptacle portion. The method also comprises folding the ground shield over an electrical connector, sandwiching the tongue between the strap and the receptacle main body, latching the latch insert portion and the latch receptacle portion together such that the insert main body is coplanar with the receptacle main body. The method also comprises fully engaging the latch receptacle portion with the latch insert portion by inserting the tongue into the slot; exerting a normal force on the tongue with the strap; and biasing the tongue into an engaged position with the receptacle main body.

Thus certain embodiments of the present invention provide a more robust latch that may be used to secure a ground shield over an electrical connector. Also, certain embodiments of the present invention provide a ground shield latch that remains engaged even without external supporting structure, such as an electrical connector, positioned underneath the latch.

Figure 1:
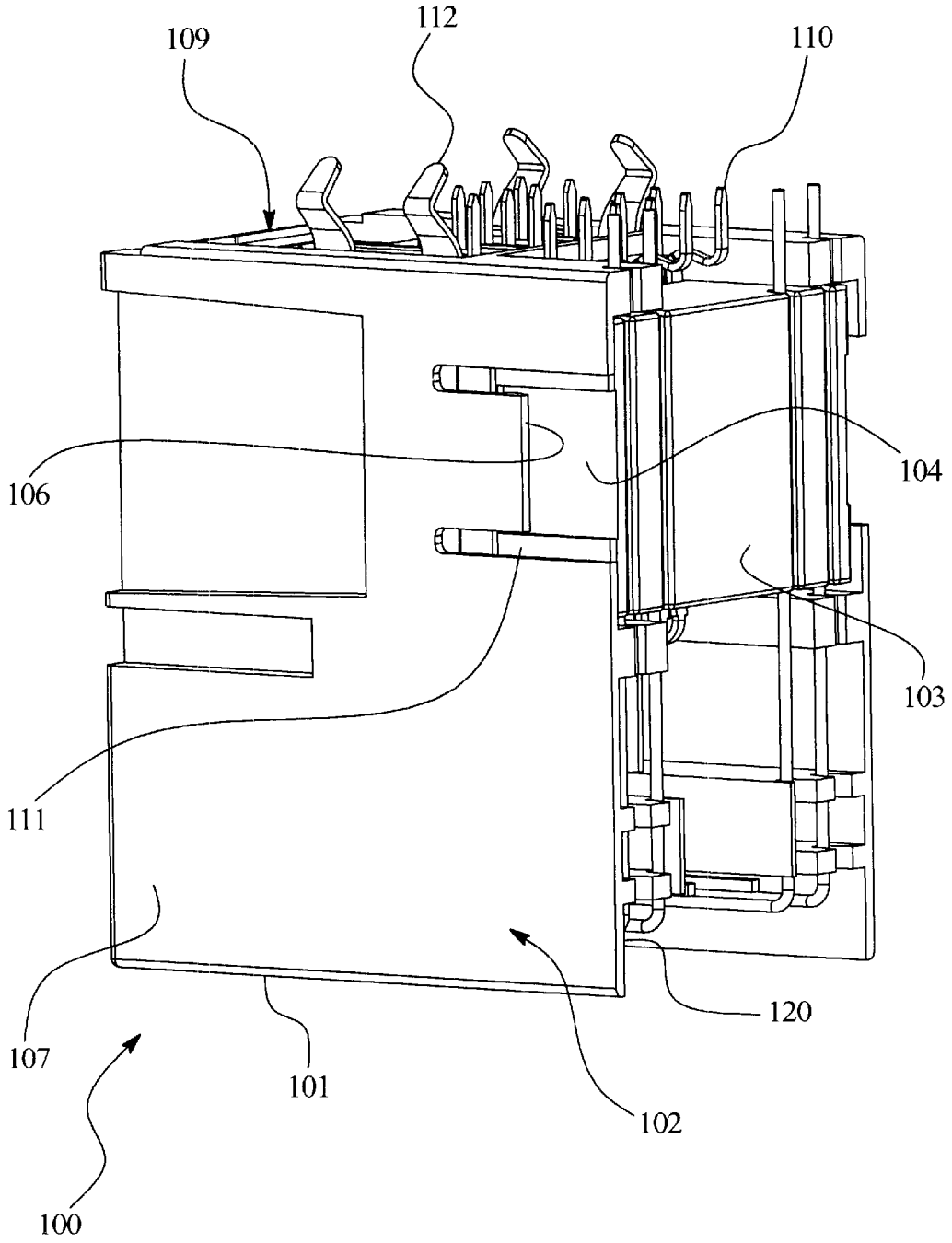
FIG. 1 is a rear isometric view of an electrical connector formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

Figure 2:
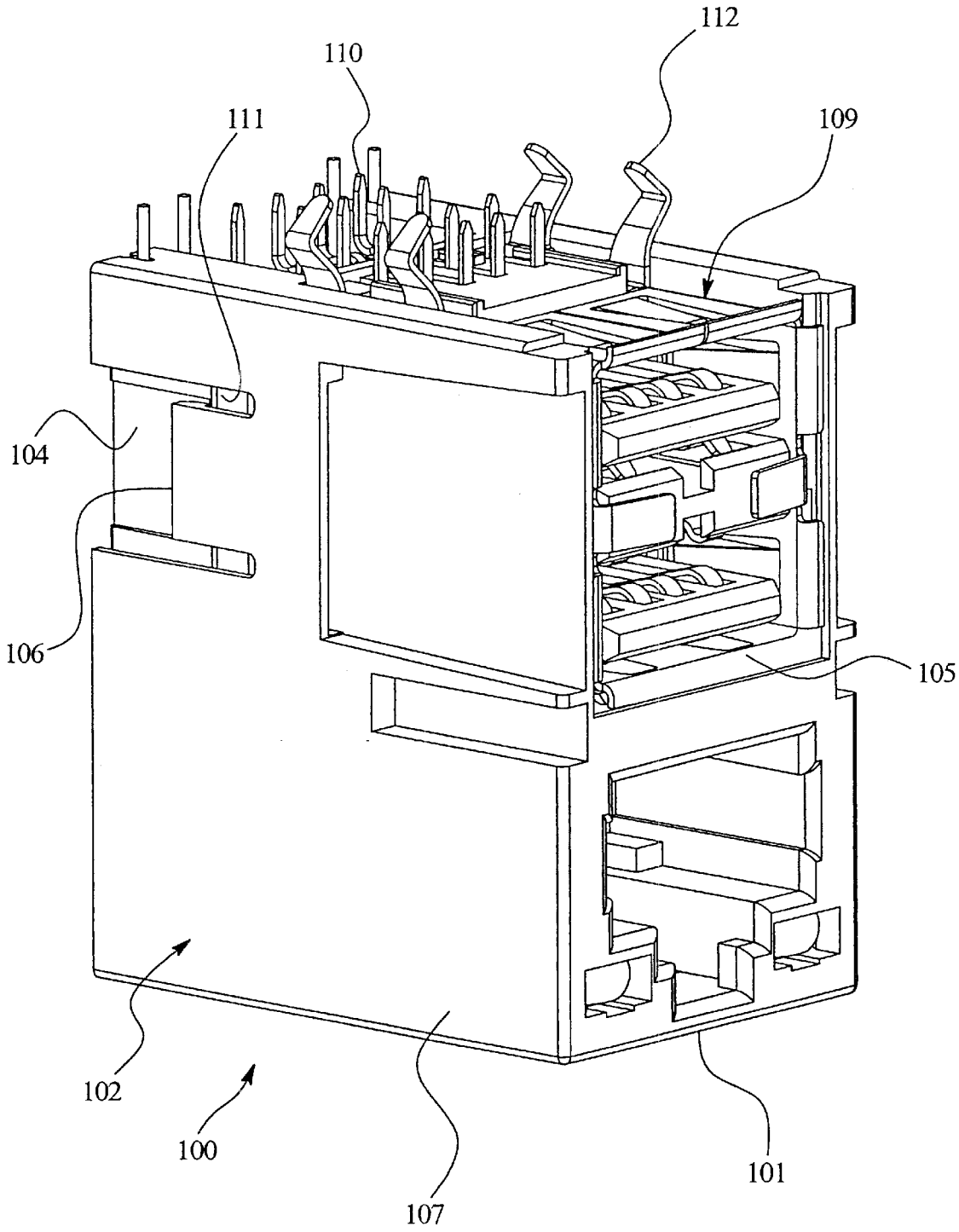
FIG. 2 is a front isometric view of an electrical connector formed in accordance with an embodiment of the present invention.

FIG. 1 is a rear isometric view of an electrical connector 100 formed in accordance with an embodiment of the present invention, while FIG. 2 is a front isometric view of the same electrical connector 100. The electrical connector 100 includes a housing 102 having lateral walls 107, a back side 103, a connector interface side 105, a base 101 and a circuit interface side 109. Contact pins 110 and positioning tabs 112 extend outward from the circuit interface side 109. Each lateral wall 107 includes a latch recess area 104 extending from a rear edge 120 of the lateral wall 107 closest to the back side 103 along the lateral wall 107. The latch recess area 104 is formed as a sunken area in the lateral wall 107. The latch recess area 104 includes latch positioning guides 111 and a recess edge 106 that define outer boundaries of the latch recess area 104.

The electrical connector 100 includes electrical elements (not shown) that contact, or are formed as part of, the contact pins 110. The circuit interface side 109 is positioned on a printed circuit board or other media, component or structure (not shown). The contact pins 110 are configured to be received and retained by receptacles in the printed circuit board. The positioning tabs 112 are configured to be received by cavities on the printed circuit board in order to assist in securing the connector 100 to the printed circuit board.

The connector 100 mates with another connector, which may be mounted on a different circuit board, through their respective connector interface sides 105. That is, electrical elements extending from, or positioned within, one connector interface side 105 of one connector 100 mate with corresponding electrical elements extending from, or positioned within, another connector interface side of another connector, thereby providing electrical paths between the connectors.

Figure 3:
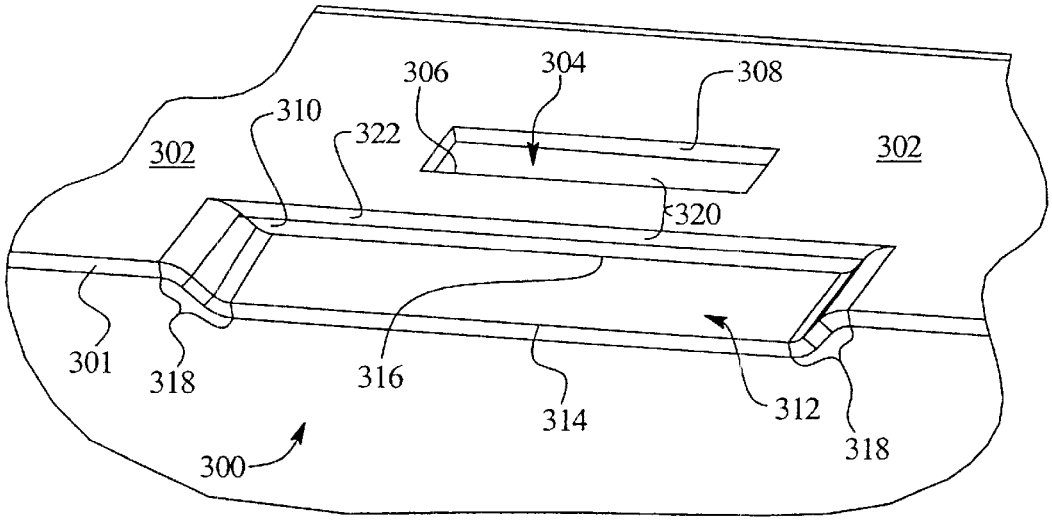
FIG. 3 is an isometric view of a latch receptacle portion formed in accordance with an embodiment of the present invention.

FIG. 3 is an isometric view of a latch receptacle portion 300 formed in accordance with an embodiment of the present invention. The latch receptacle portion 300 is stamped, blanked or otherwise formed proximate a first edge 301 of the ground shield main body 302. The latch receptacle portion 300 is stamped into the metallic ground shield by a forming die and the like. The latch receptacle portion 300 includes a strap 312 at the first edge 301 of the ground shield main body 302, a window 304, and a clearance area 320 formed between the strap 312 and the window 304. The strap 312 is offset downward from the plane of the ground shield main body 302. The strap 312 is connected to the ground shield main body 302 through the curved or ramped offset portions 318. The strap 312 includes a front edge 314 and a rear edge 316. A slot 310 is formed by the offset of the strap 312 from the ground shield main body 302. The clearance bridge 320 includes a clearance edge 322 positioned over the slot 310. The clearance bridge 322 is positioned in the same plane as the ground shield main body 302. The window 304 includes a leading edge 306 bounding the clearance bridge 320 and a trailing edge 308 distally positioned from the clearance bridge 320. The only portions of the receptacle portion 300 that are not coplanar with the ground shield main body 302 are the strap 312 and the ramped offset portions 318, which both are offset below the ground shield main body 302. As shown in FIG. 3, the clearance bridge 320 is formed further into the ground shield main body 302 as compared to the strap 312, which is formed at the first edge 301. The window 304, in turn is formed further into the ground shield main body 302 as compared to the clearance bridge 320.

Alternatively, more than one strap 312 may be formed within the receptacle portion 300. For example, two straps 312 may be formed in line with one another along the edge 301. Also, alternatively, an additional strap may be positioned under the window 304. The additional straps may be connected to the ground shield main body 302 through offset portions similar to offset portions 318.

Figure 4:
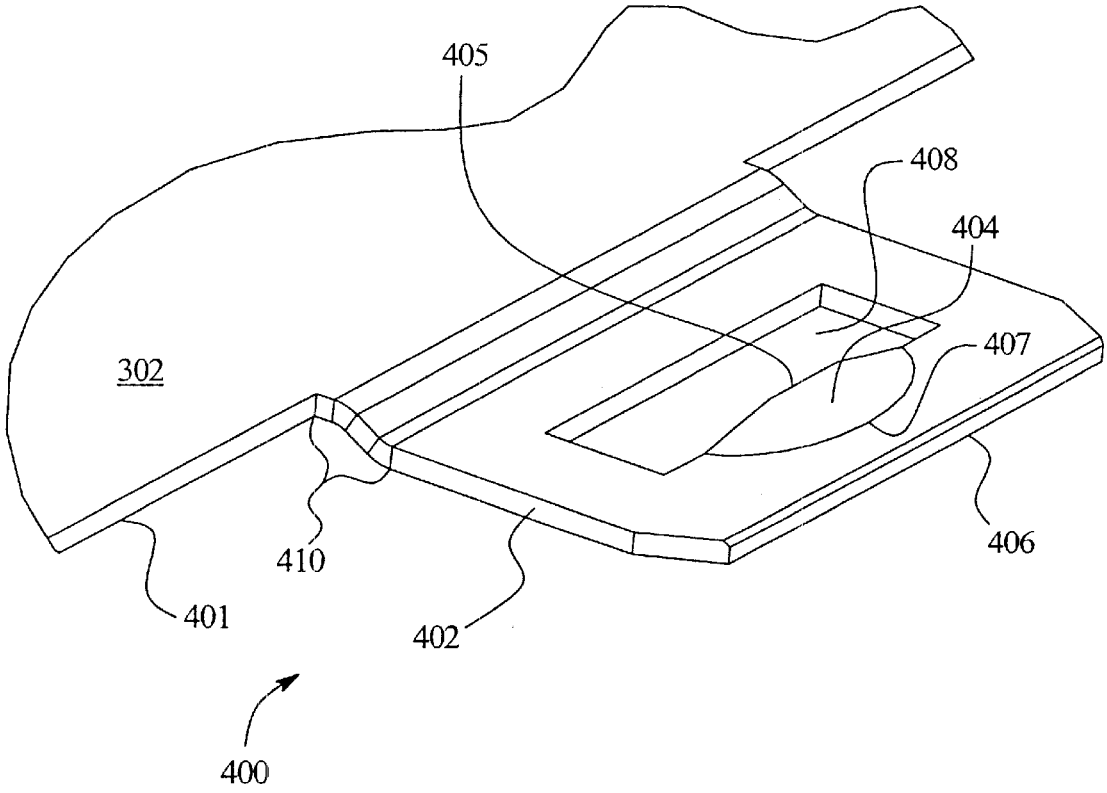
FIG. 4 is an isometric view of a latch insert portion formed in accordance with an embodiment of the present invention.

FIG. 4 is an isometric view of a latch insert portion 400 formed in accordance with an embodiment of the present invention. The latch insert portion 400 may be formed on and extend outward from, the same metallic ground shield as that of the latch receptacle portion 300. That is, the latch insert portion 400 may extend outward from, and below, a second edge 401 of the ground shield main body 302. The insert portion 400 is blanked, stamped, or otherwise formed into the metallic ground shield by a forming die and the like. The latch insert portion 400 includes a tongue 402 and an offset portion 410. The tongue 402 is connected to the ground shield main body 302 through the offset portion 410. The tongue 402 includes a latching projection 404, a beveled edge 406 and an opening 408. The latching projection 404 is a semi-spherical, or otherwise rounded protrusion, that includes an edge 405 and a rounded base 407. The edge 405 defines one side of the opening 408. While the tongue 402 is offset below the plane of the ground shield main body 302, the tongue 402 is not offset at, or below, the corresponding level of the strap 312 of the receptacle portion 300. The latching projection 404 is formed closer to the ground shield main body 302 as compared to the beveled edge 406, which is at a terminal end of the tongue 402. The opening 408 is formed closer to the ground shield main body 302 as compared to the latching projection 404.

Alternatively, an opening 408 may not be formed in the tongue 402. Also, alternatively, the latching projection 404 may be formed as a different shape, such as a block.

Figure 5:
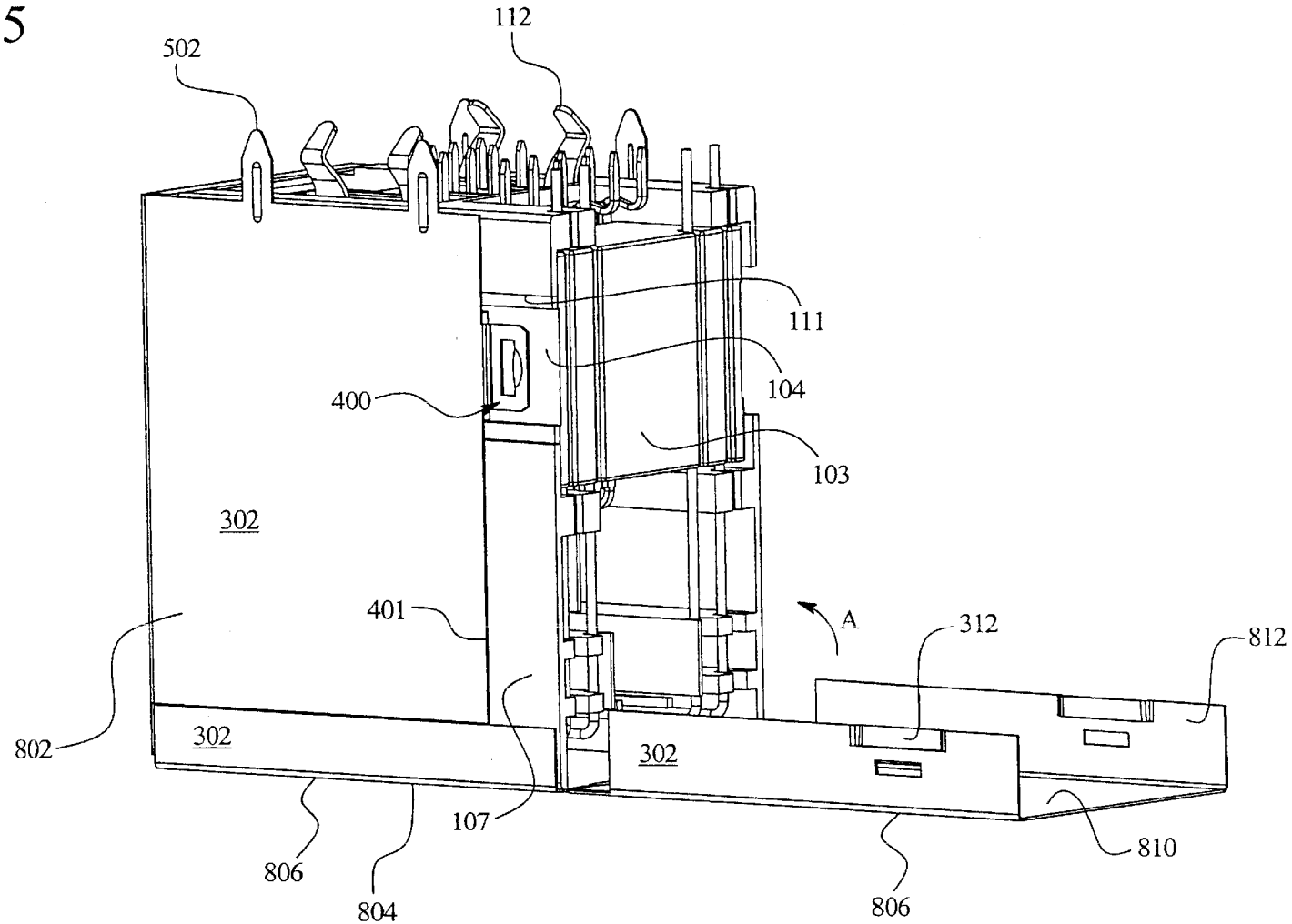
FIG. 5 is a rear isometric view of a ground shield main body partially mounted on an electrical connector according to an embodiment of the present invention.
Figure 6:
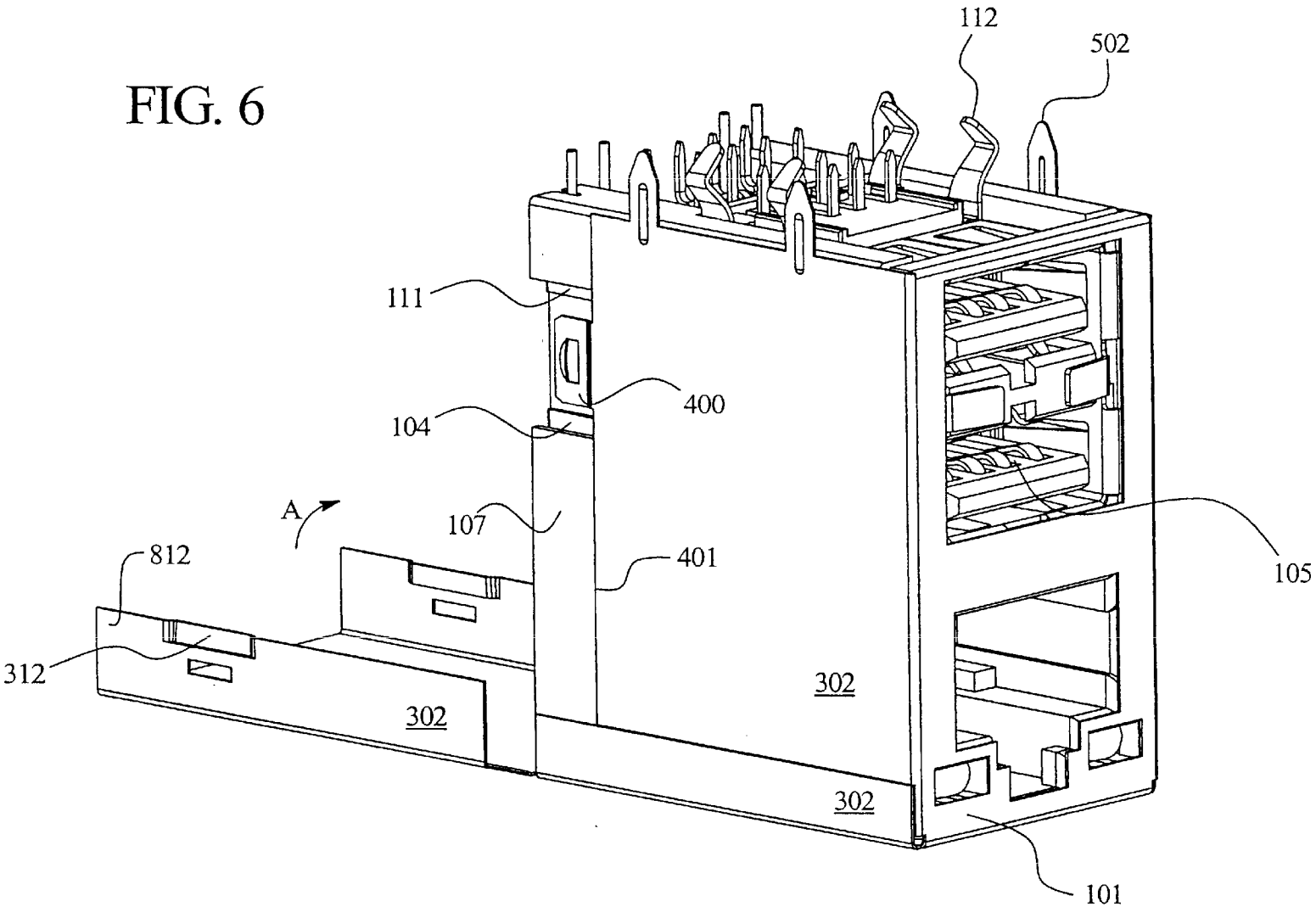
FIG. 6 is a front isometric view of a ground shield main body partially mounted on an electrical connector according to an embodiment of the present invention.

FIG. 5 is a rear isometric view of a ground shield main body 302 partially mounted on an electrical connector according to an embodiment of the present invention, while FIG. 6 is a front isometric view of the same ground shield main body 302. The ground shield main body 302 also includes circuit board engagement tabs 502, which may be inserted into cavities (not shown) of a printed circuit board. The circuit board engagement tabs 502 assist in providing a stable connection between the ground shield main body 302 and the printed circuit board when the ground shield main body 302 is fully positioned over the connector 100, and the ground shield main body 302 and the connector 100 are mounted on the printed circuit board.

Figure 10:
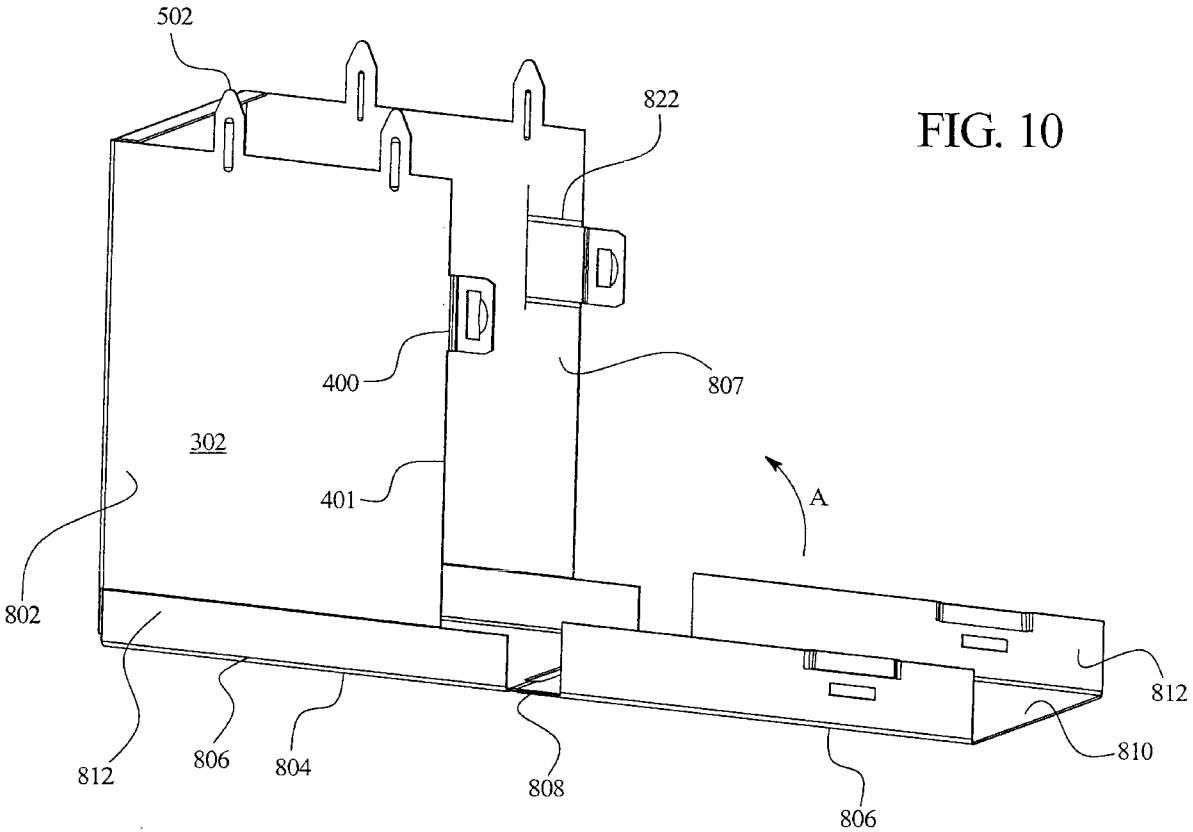
FIG. 10 is a rear isometric view of a partially folded ground shield main body formed in accordance with an embodiment of the present invention.
Figure 11:
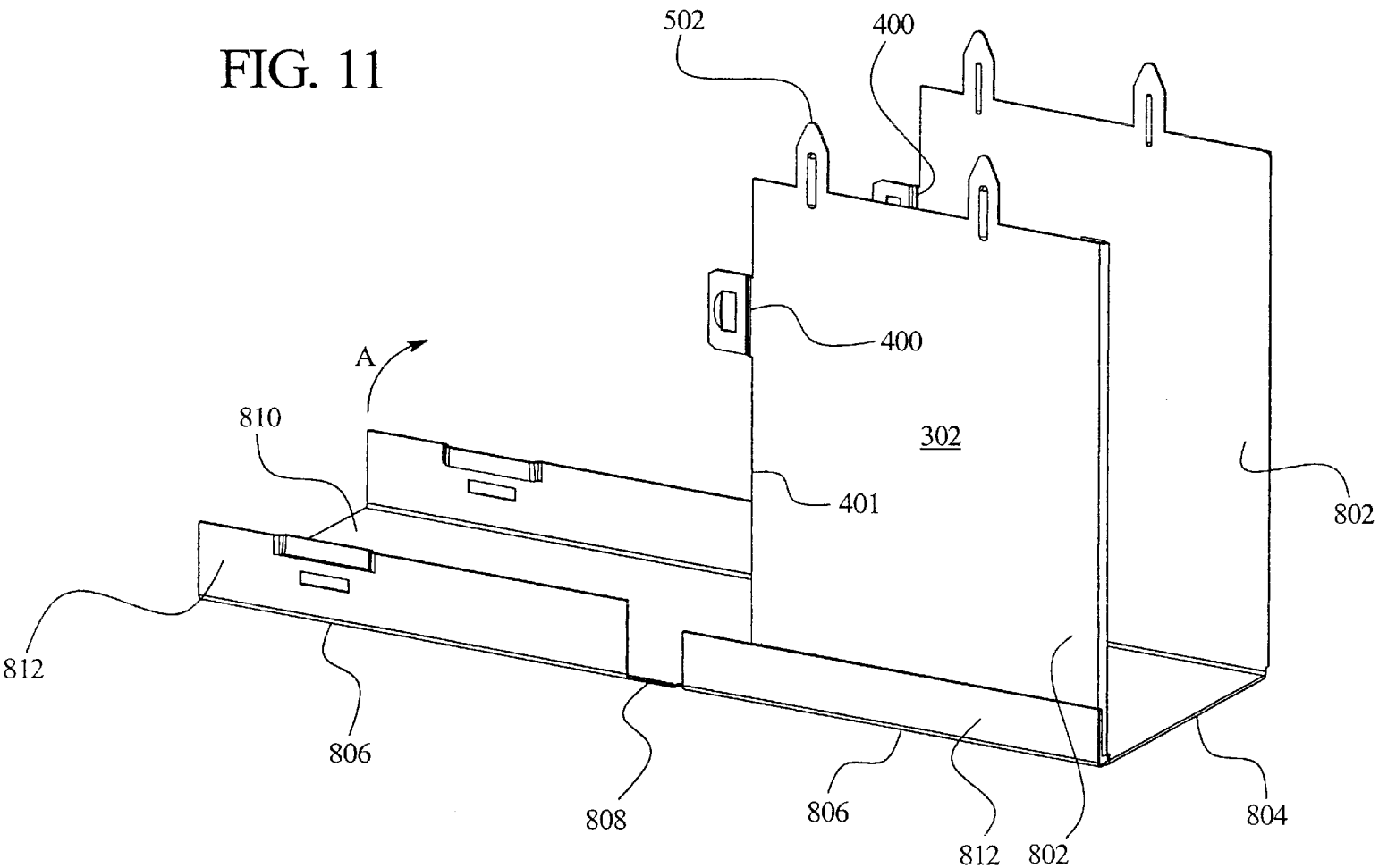
FIG. 11 is a front isometric view of a partially folded ground shield main body formed in accordance with an embodiment of the present invention.

FIG. 10 is a rear isometric view of a partially folded ground shield main body 302 formed in accordance with an embodiment of the present invention, while FIG. 11 is a front isometric view of the same partially folded ground shield main body 302. The partially folded ground shield 302 includes sidewalls 802, a bottom wall 804, transition edges 806, clearance notches 808, a rear wall 810, side flanges 812, and guiding members 822. The ground shield main body 302 may be formed from a unitary metallic ground sheet.

The ground shield main body 302 may be folded around a connector 100 (not shown in FIGS. 10 and 11) in a variety of ways. The side walls 802 may be folded up while side flanges 812 of the bottom wall 804 fold over the side walls 802 forming transition edges 806. Additionally, transition edges 806 on the rear wall 810 may be formed by the right angle folding of the folded portions 812 with respect to the rear wall 810. Guiding members 822 formed in the interior of the sidewalls 802 interface with the latch positioning guides 111 of the connector 100 (as shown in FIGS. 1 and 2). While the rear wall 810 is shown in an unfolded state, arrow A denotes the folding direction of the rear wall 810 toward the connector. Upon the folding of the rear wall 810 toward the connector 100, the clearance notches 808 provide a folding transition area. That is, the clearance notches 808 ensure a proper right angle transition between the bottom wall 804 and the rear wall 810.

Referring to FIGS. 5, 6, 10 and 11, the ground shield main body 302, such as the bottom wall 804 as shown in FIGS. 10 and 11, covers the base 101 of the connector 100. The side walls 802 of the ground shield main body 302 are folded over the lateral walls 107 of the connector 101 such that the insert portions 400 extending from the ground shield main body 302 are positioned within the latch recess areas 104. The ground shield main body 302 may have guiding members 822 formed on its underside, which contact the lateral walls 107 of the connector 100. The guiding members 822 may position the insert portions 400 into the latch recess area 104 by slidably and/or frictionally engaging the latch positioning guides 111. That is, the latch positioning guides 11 may receive and slidably retain the guiding members. Alternatively, the receptacle portions 300 may be positioned within the latch recess area 104 before the insert portions 400.

The offset portion 410 of the latch insert portion 400 abuts the recess edge 106 of the latch recess area 104 when the ground shield main body 302 is positioned over the lateral walls 107. As shown in FIGS. 5, 6, 10 and 11, the rear wall 810 of the ground shield main body 302 that will cover the back side 103 of the connector 100 is not bent into position over the back side 103 of the connector 100. However, side flanges 812 having the receptacle portions 300 located thereon are shown bent upward.

Figure 7:
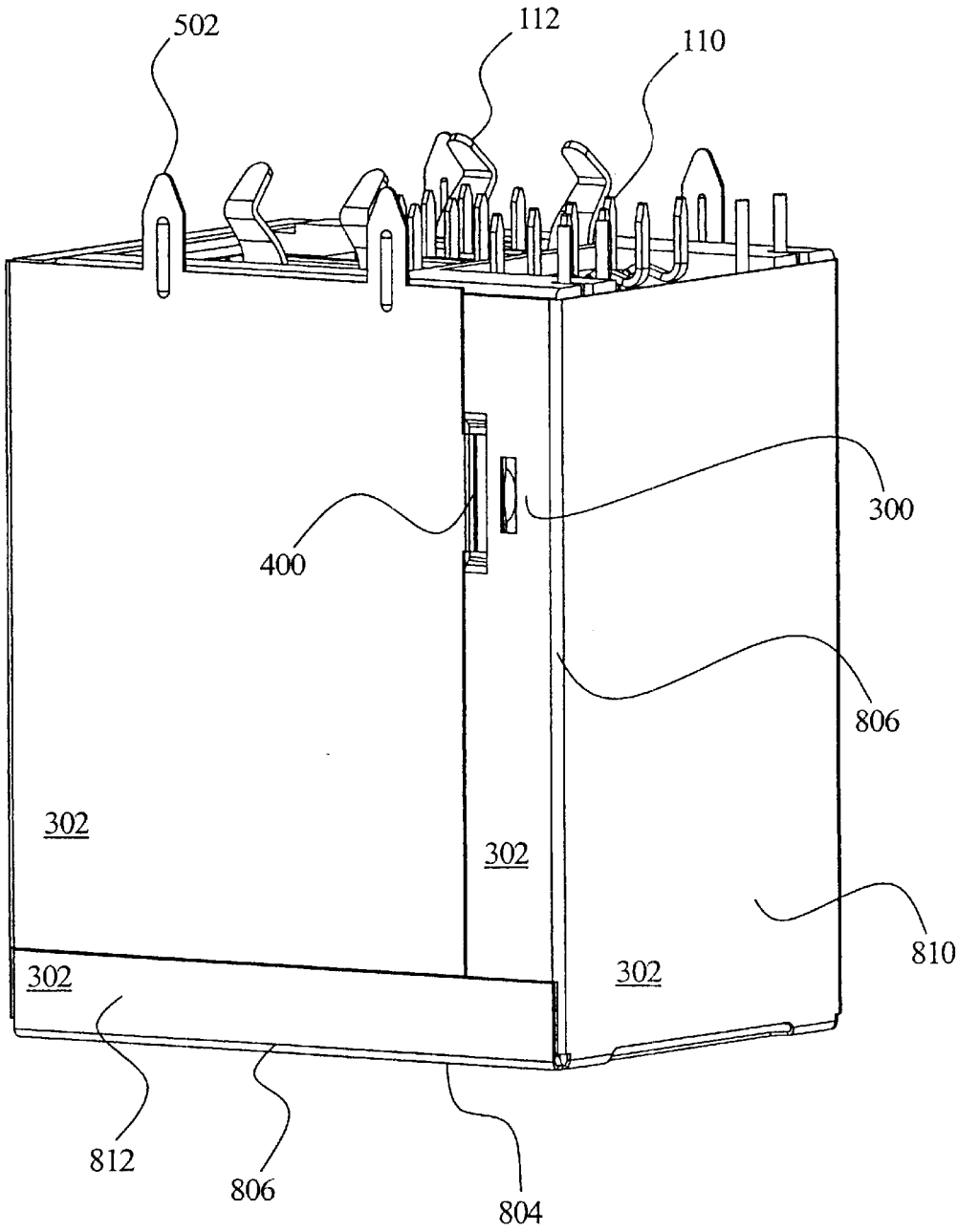
FIG. 7 is a rear isometric view of a ground shield main body fully mounted over an electrical connector according to an embodiment of the present invention.
Figure 8:
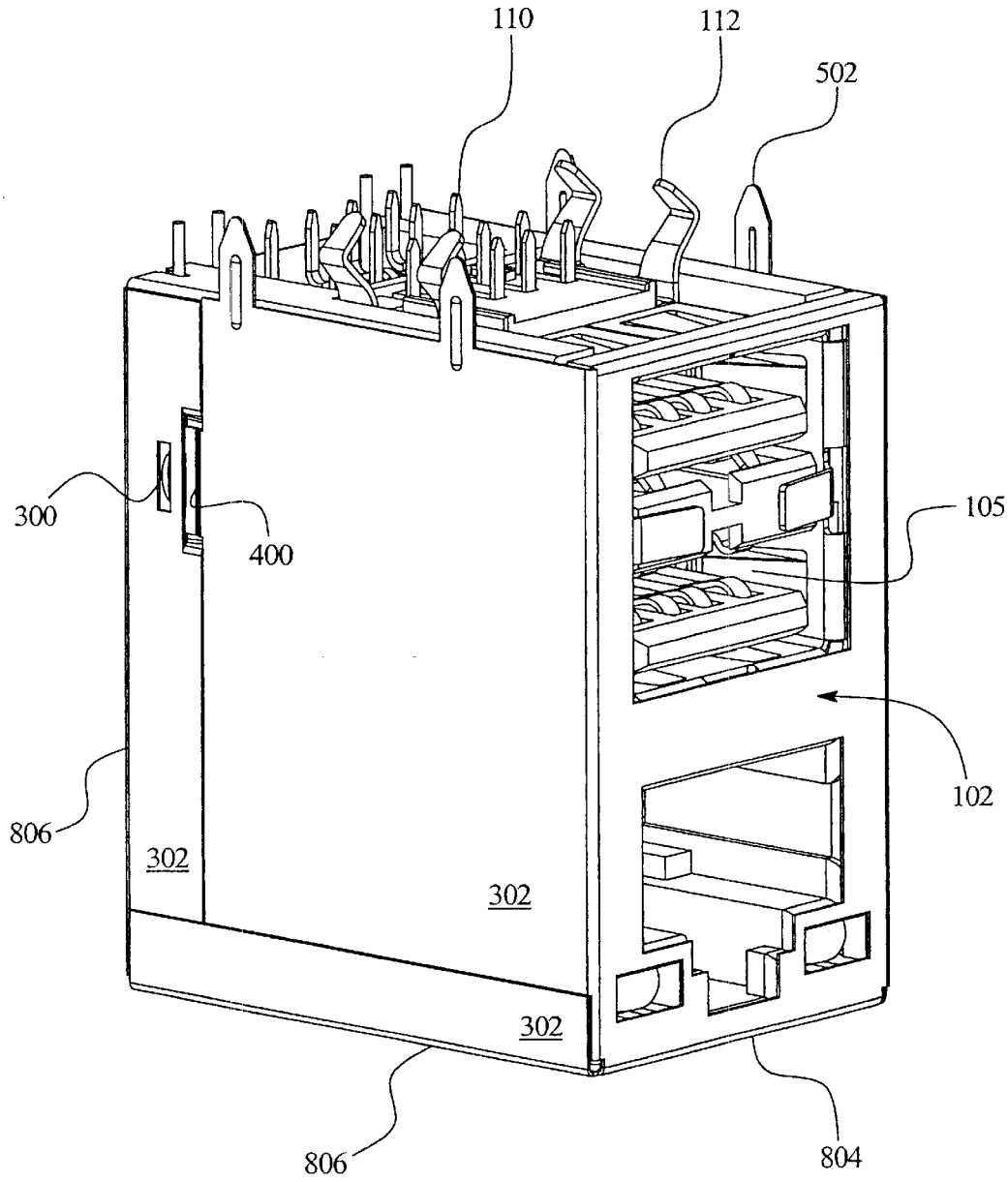
FIG. 8 is a front isometric view of a ground shield main body fully mounted over an electrical connector according to an embodiment of the present invention.

FIGS. 7 and 8 are isometric views of a ground shield main body 302 fully mounted over an electrical connector 100 according to an embodiment of the present invention. As shown in FIGS. 7 and 8, the ground shield main body 302 covers the lateral walls 107, the base 101 and the back side 103. The connector interface side 105 and the circuit interface side 109 are not covered by the ground shield main body 302, in order to allow an unimpeded interface between mating surfaces of different connectors 100 and/or circuit boards.

Figure 9:
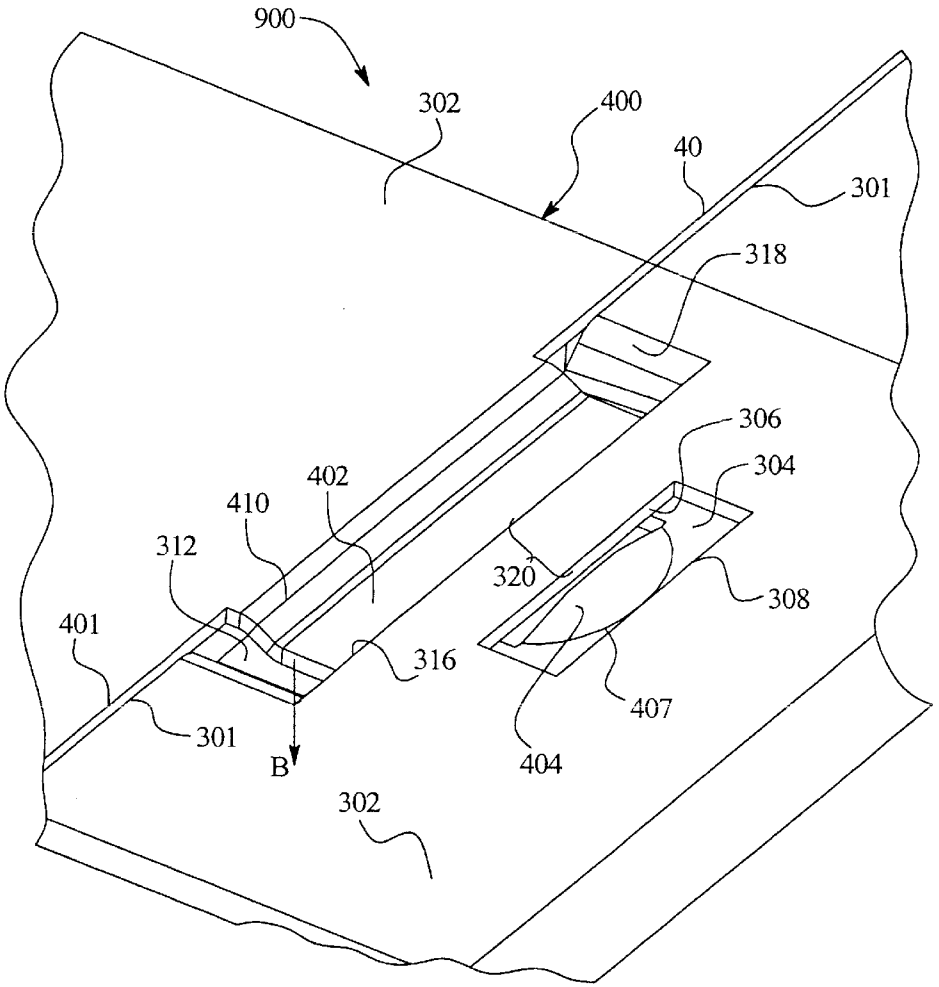
FIG. 9 is an isometric view of a fully engaged latch assembly formed in accordance with an embodiment of the present invention.

FIG. 9 is an isometric view of a fully engaged latch assembly 900 formed in accordance with an embodiment of the present invention. In order to fully engage the latch 900, the receptacle portion 300 and the insert portion 400 are moved toward one another. Referring to FIGS. 3, 4 and 9, as the receptacle portion 300 engages the insert portion 400, the beveled edge 406 of the tongue 402 passes over the front edge 314 of the strap 312 and subsequently passes over the rear edge 316 of the strap 312. After the beveled edge 406 of the tongue 402 passes over the strap 312, the beveled edge 406 enters the slot 310. As the beveled edge 406, and therefore, the tongue 402, pass into the slot 310, the rounded base 407 encounters the clearance edge 322 of the receptacle portion 300. As the rounded base 407 passes into the slot 310, the tongue 402 is deflected downward in the direction of arrow B so that the tongue 402 may continue to pass into the slot 310. Alternatively, the strap 312 may deflect downward in the direction of arrow B to permit the tongue 402 to pass into the slot 310.

The tongue 402 of the insert portion 400 continues to pass through the slot 310 such that the rounded base 407 traverses, or passes under, the clearance bridge 320. The strap 312 exerts a constant normal force upon the tongue 402 such that the latching projection 404 is pushed into, or biased against, the underside of the clearance bridge 322. As the tongue 402 continues to pass under the clearance bridge 320, the rounded base 407 passes under leading edge 306 of the window 304. The rounded shape of the rounded base 407 decreases the chance of the rounded base 407 from snagging on the leading edge 306. The tongue 402 continues to pass into the slot 310 until the edge 405 of the latching projection 404 encounters the leading edge 306 of the window 304. As the edge 405 of the latching projection 404 encounters the leading edge 306, the normal force exerted on the tongue 402 by the strap 312 causes the latching projection 404 to bias into the window 304 of the receptacle portion 300. As the latching projection 404 protrudes, or is biased, into the window 304, the edge 405 of the latching projection 404 abuts the leading edge 306 of the window 304, while the rounded base 407 abuts the trailing edge 308, at which point the latch 900 is fully engaged.

Upon full engagement of the latch assembly 900, the opening 408 formed in the tongue 402 is positioned under the clearance bridge 322 of the receptacle portion 300. Also, upon full engagement of the latch assembly 900, the first edge 301 of the ground shield main body 302 abuts the second edge 401 of the ground shield main body 302, such that the ground shield main body 302 of the receptacle portion 300 is coplanar with the ground shield main body 302 of the insert portion 400. Further, because the strap 312 of the receptacle portion 300 exerts a constant uniform force into the underside of the tongue 402, the latch assembly 900 remains fully engaged without any non-latch structure underneath the latch assembly 900. That is, the latch assembly 900 remains engaged even without a lateral wall 107 of the electrical connector 100 exerting a normal force from underneath the latch assembly 900. Additionally, no portion of the latch assembly 900 is above the plane of the main body 302 of the receptacle portion 300 or the main body of the insert portion 400.

Thus certain embodiments of the present invention provide a more robust latch that may be used to secure a ground shield over an electrical connector. Also, certain embodiments of the present invention provide a ground shield latch that remains engaged even without external supporting structure, such as an electrical connector, positioned underneath the latch.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A system for securing a ground shield around an electrical connector, said system comprising:

an electrical connector; and a unitary ground shield folded around portions of said electrical connector, said ground shield comprising a rear wall having a folded portion along an edge of said rear wall, said folded portion having a first end, said ground shield having a side wall with a second end, said ground shield including a latch assembly latching said first and second ends of said ground shield together such that said side wall and said folded portion are joined in a common plane, said latch assembly comprising a latch receptacle portion formed on said first end of said folded portion, said latch receptacle portion comprising a strap arranged in a plane parallel to said common plane and spaced apart from said common plane by a slot, said latch assembly further comprising a latch insert portion formed on said second end of said side wall, said latch insert portion comprising a tongue with a latching member thereon offset from said common plane.

2. The system of claim 1 wherein said latch receptacle portion includes a clearance bridge, and wherein said tongue is received by said slot and deflected as said tongue traverses said clearance bridge before said latching member is biased into an engaged position with said receptacle main body.

3. The system of claim 1 wherein said latch receptacle portion includes a clearance bridge, and wherein said tongue is received by said slot and said strap is deflected as said tongue traverses said clearance bridge before said latching member is biased into an engaged position with said receptacle main body.

4. The system of claim 1 wherein said strap and said receptacle main body sandwich said tongue therebetween.

5. The system of claim 1, wherein said latching member includes a semi-spherical protrusion configured to pass through said slot.

6. The system of claim 1, wherein said latching member is fixedly formed on said tongue.

7. A method of manufacturing a ground shield for an electrical connector, said method comprising:

folding a ground shield to form a side wall and a rear wall, the rear wall having a flange extending along an edge of the rear wall;

stamping a latch receptacle portion, having a receptacle main body, a window and a strap, from an end of the flange;

stamping a latch insert portion, having an insert main body and a tongue, from an end of the side wall;

forming a latching projection fixedly on, and extending outward from, the tongue;

offsetting the strap and tongue from planes defined by the receptacle and latch main bodies, respectively, such that the receptacle and latch main bodies, when joined, are aligned in a common plane and the strap and tongue are offset from the common plane.

8. The method of claim 7 further comprising folding the ground shield over an electrical connector.

9. The method of claim 7 further comprising sandwiching the tongue between the strap and the receptacle main body.

10. The method of claim 7 further comprising fully engaging the latch receptacle portion with the latch insert portion by inserting the tongue into the slot; exerting a normal force on the tongue with the strap; and biasing the tongue into an engaged position with the receptacle main body.

11. The method of claim 7, further comprising forming said latching projection as a semi-spherical protrusion on said tongue.

12. The method of claim 7, further comprising from said latching projection with a rounded base configured to pass through the slot.

* * * * *